US005868476A

United States Patent [19]

Samborn et al.

[11] Patent Number: 5,868,476

[45] Date of Patent: Feb. 9, 1999

[54] SELF-SERVE FOOD PRODUCT DISPENSER

[75] Inventors: Michael R. Samborn, Atlanta; William Randolph Dudley, Jr., Lawrenceville, both of Ga.

[73] Assignee: Kraft Foods, Inc., Northfield, Ill.

[21] Appl. No.: 907,246

[22] Filed: Aug. 6, 1997

[51] Int. Cl.[6] ..... A47F 3/10

[52] U.S. Cl. ..... 312/125; 312/210.5; 312/117; 221/132

[58] Field of Search ..... 312/125, 114, 312/118, 121, 135, 137, 210, 210.5, 211, 212; 221/123, 124, 132

[56] References Cited

U.S. PATENT DOCUMENTS

| | | | |
|---|---|---|---|
| 2,013,901 | 9/1935 | Shankland | 221/132 |
| 2,044,518 | 6/1936 | Thorstensen | 312/125 X |
| 2,078,813 | 4/1937 | Sarullo et al. | 312/125 |
| 2,209,807 | 7/1940 | Belsky | 312/210.5 X |
| 2,756,901 | 7/1956 | Cowsert | 221/132 |
| 4,632,474 | 12/1986 | Ingersoll | 312/125 X |
| 5,026,128 | 6/1991 | Groetzinger | 312/210.5 |

OTHER PUBLICATIONS

One page of advertising information showing Cal•Mil acrylic bulk food bins or dispensers (No Date Given).

*Primary Examiner*—Peter M. Cuomo
*Assistant Examiner*—James O. Hansen
*Attorney, Agent, or Firm*—Fitch, Even, Tabin & Flannery

[57] ABSTRACT

A compact self-service bagel dispenser which provides customers with a selection of a plurality of different groups of bagels, and a plurality of different bagels within each group, within a small dispensing area. To provide convenient access to different varieties or groups of bagels within a relatively compact "footprint" on a counter surface, the dispenser preferably comprises a rotatable bin having a plurality of separate compartments separated from one another by generally vertical dividers. Each compartment preferably has an open upper end into which bagels may be loaded, a lower dispensing area, and a transition portion through which bagels travel from the upper end to the lower dispensing area. The rotatable bin is preferably supported on a fixed base. The bin preferably includes a bottom wall having a plurality of openings therein to permit crumbs, seeds, and other particulate materials to fall into a receptacle supported by the base. In the illustrated embodiment, the base includes an annular track for rotatably supporting the bin, and a shield is provided over the track to address the problem of seeds or other material bouncing onto the track from the adjacent exterior counter surface.

4 Claims, 3 Drawing Sheets

SELF-SERVE FOOD PRODUCT DISPENSER

BACKGROUND OF THE INVENTION

1. Field of the Invention

The invention relates generally to self-serve food product dispensers.

2. Background and Description of Related Art

Cafeterias, vending areas, convenience stores and restaurants often have self-serve apparatuses for dispensing to consumers one or more different types of wrapped or unwrapped food products, such as different types of baked goods.

Known dispensing arrangements for unwrapped food products, such as the display cabinet described in U.S. Pat. No. 2,078,813, may have crumbs, seeds and similar items accumulate in the bottom thereof. Such an accumulation of separated items may be unsightly and may be undesirable for other reasons as well.

Further, known food product dispensers may be rather bulky, and may take up unduly great amounts of counter space, which may be limited.

Many known food product dispensers also dispense food products on a first in, last out basis (the first products loaded into the dispensers are generally the last products which are made available to consumers). These dispensers, thus, do not provide uniform product rotation and freshness.

There is a need for an improved self-serve apparatus for dispensing more than one type of food product to consumers, particularly food products which are not wrapped, and from which crumbs, seeds and similar items may become separated, such as several different varieties of bagels.

It is a general object of the invention to provide an improved self-serve apparatus for dispensing more than one type of food product from a compact space which may be suitable for use in, e.g., cafeterias, convenience stores, and/or vending areas where counter space is limited, and compactness is highly desirable.

A further object of the invention is to provide an apparatus for dispensing more than one type of food product which is easy to use, both from the standpoint of the consumer who is receiving product from the dispenser, as well as from the standpoint of persons responsible for setup, filling, removal of unused product for storage, and cleaning of the dispenser.

Additional objects and advantages of the invention are set forth hereinbelow and are shown in the accompanying drawings.

SUMMARY OF THE INVENTION

The present invention provides a rotatable, self-serve apparatus for dispensing more than one different type of food product, such as different varieties of bagels or other baked goods, from a compact space.

The preferred embodiment of the invention comprises a compact self-service bagel dispenser which provides customers with a selection of a plurality of different groups of bagels, and a plurality of different bagels within each group, within a small dispensing area.

To provide convenient access to different varieties or groups of bagels within a relatively compact "footprint" on a counter surface, the dispenser preferably comprises a rotatable bin having a plurality of separate compartments separated from one another by generally vertical dividers. Each compartment preferably has an open upper end into which bagels may be loaded, a lower dispensing area, and a transition portion through which bagels travel from the upper end to the lower dispensing area. The upper end may selectively be closed by a removable lid or cover. Each lower dispensing area preferably has a separate door for selective access thereto, for dispensing of the bagels. Each lower dispensing area is sufficiently large to hold a plurality of bagels, so that customers may choose from among a plurality of different bagels within each group. Thus, while the dispenser provides a generally first-in, first-out dispensing arrangement, the dispensing arrangement is flexible to permit the customer to choose the particular bagel or bagels desired in each group.

The rotatable bin is preferably supported on a fixed base. The bin preferably includes a bottom wall having a plurality of openings therein to permit crumbs, seeds, and other particulate materials to fall into a receptacle supported by the base. The receptacle may comprise, for example, a drawer slidably mounted in the base which receives crumbs and the like, and which may be removed from the base to facilitate disposal of the crumbs.

The bin in the preferred embodiment comprises a stack of components which are mechanically interengageable without separate fasteners, to enable the bin to be assembled and disassembled for cleaning without the use of tools.

In the illustrated embodiment, the base includes a track for rotatably supporting the bin, and a shield is disposed over the track to prevent seeds or other particulates from falling into the track. One or more of the dividers may be removable to enable adjacent compartments to be combined.

Additional features of the invention are set forth below, and shown in the accompanying drawings.

DETAILED DESCRIPTION OF PREFERRED EMBODIMENTS

Figure 1:
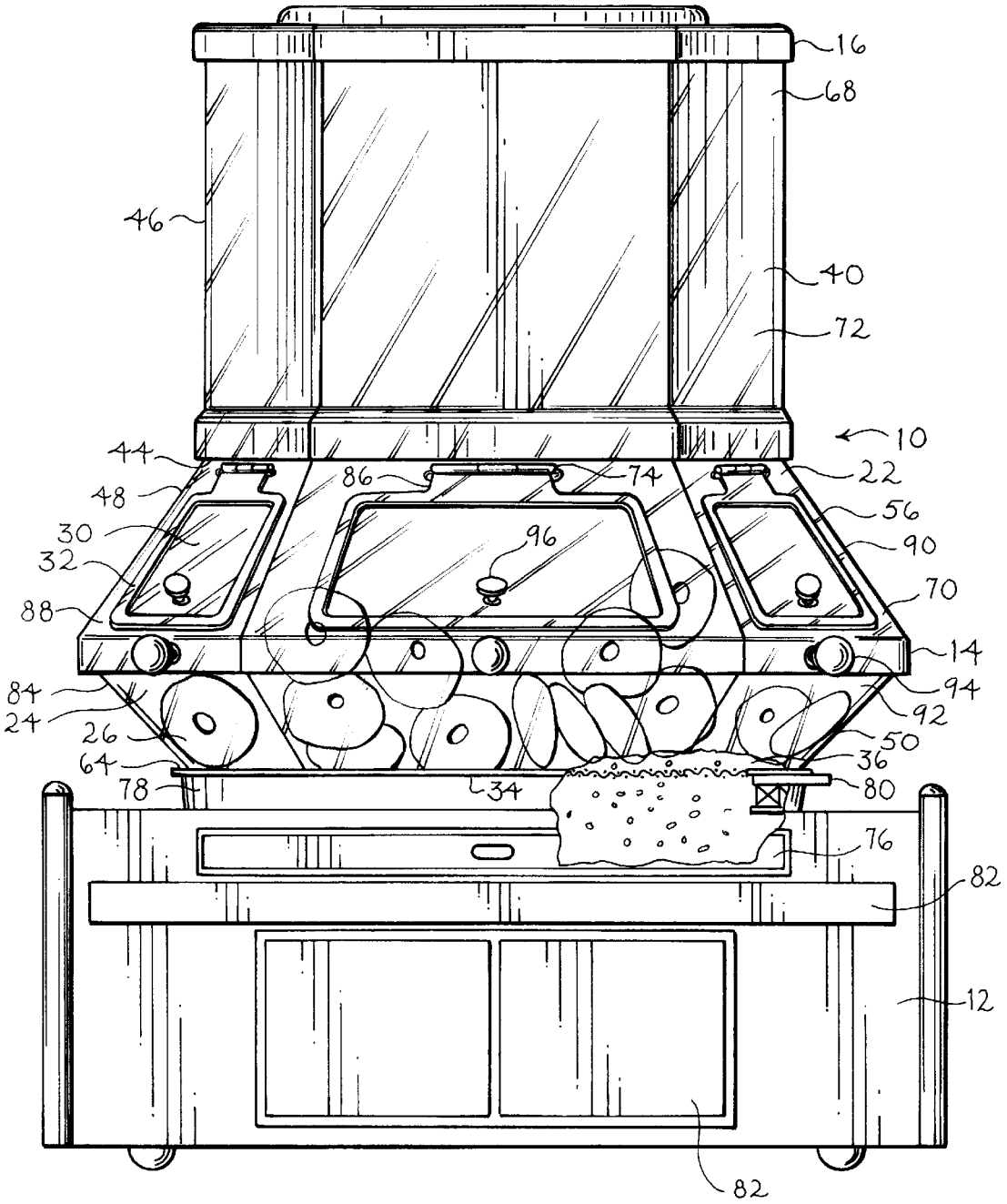
FIG. 1 is a front elevational view of a preferred embodiment of the invention.

The present invention is preferably embodied in a rotatable, self-serve dispenser which can dispense large quantities of more than one different type of food product from a compact space generally on a first in, first out basis. The present invention is not limited to the precise arrangements, configurations, dimensions and/or instrumentalities shown in the drawings, or described hereinbelow.

Preferred embodiments of the food product dispensers of the present invention will now be described with reference to the drawings. In the drawings, like reference symbols indicate the same parts of the food product dispensers throughout the three different views thereof.

Figure 2:
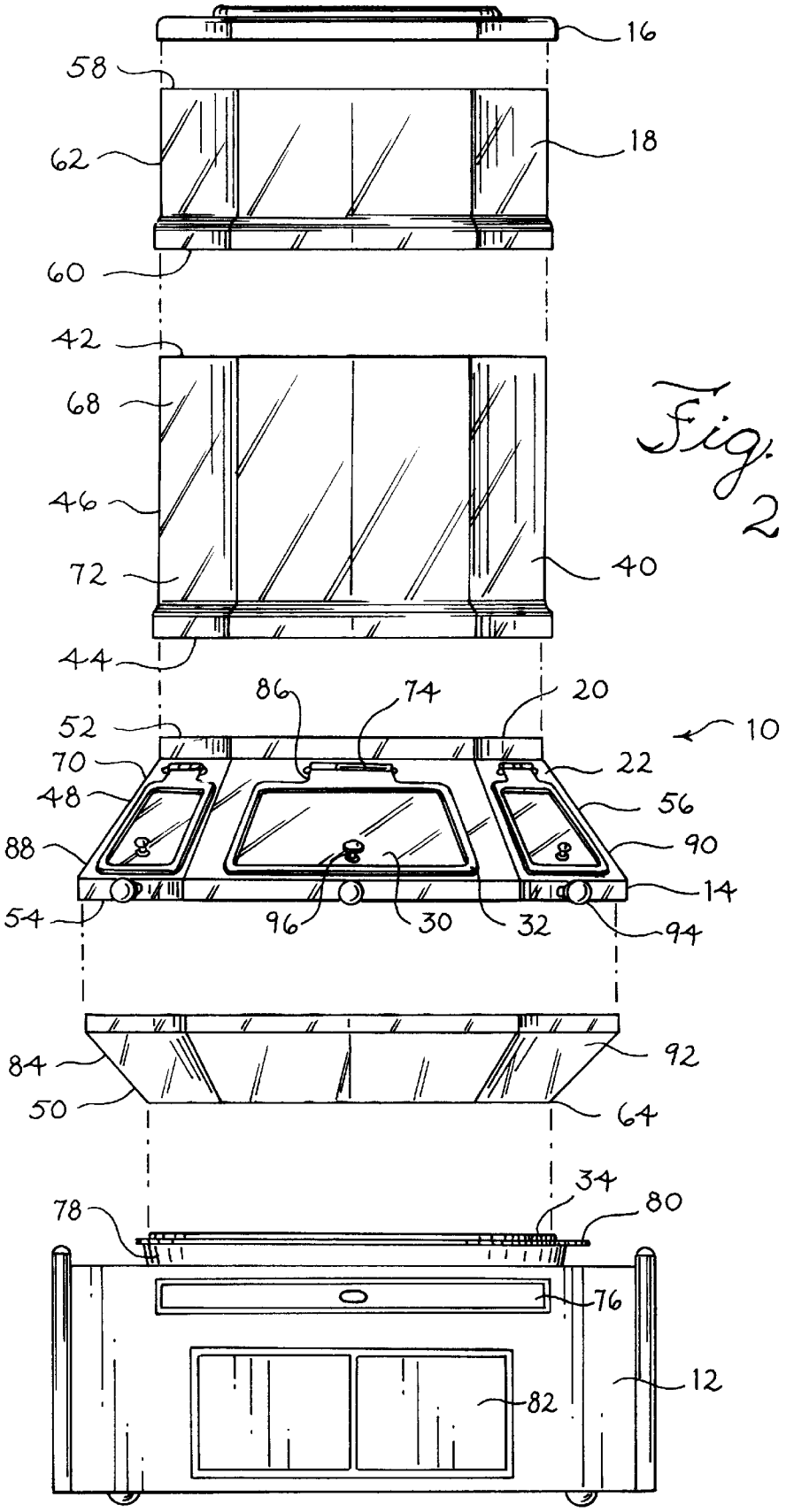
FIG 2 is an exploded front elevational view showing the dispenser in combination with a bin extension.

The dispenser illustrated in the accompanying figures generally comprises a compact self-service bagel dispenser 10 which provides customers with a selection of a plurality of different groups of bagels, and a plurality of different bagels within each group, within a small dispensing area. The illustrated bagel dispenser 10 comprises a fixed base 12, a rotatable bin 14 supported on the base 12, and a removable lid 16 for the bin 14. As shown in FIG. 2, the dispenser 10 may further comprise a bin extension 18 to increase the capacity of the dispenser 10.

The bin 14 is preferably transparent and preferably has an open top 20, partially closed sides 22, space 24 for the storage of more than one different type of food product 26, at least one vertical partition (divider) 28 to separate the different food products 26, at least one opening 30 and one door 32 in the sides 22 for each type of food product 26 being stored therein through which the food product 26 may be accessed from outside of the bin 14 by consumers, a bottom wall 34 containing a plurality of openings 36 through which crumbs, seeds, and like items may fall.

As is shown in FIGS. 1 and 2, it is preferable that the bin 14 be separable into a bin stack 40 for storing food product 26 which has an open top 42 and bottom 44 and closed sides 46, an upper bin member 48 below the bin stack 40 for storing and dispensing food product 26 and a lower bin member 50 below the upper bin member 48 for storing food product 26. As is shown in FIG. 2, the upper bin member 48 has an open top 52 and bottom 54 and partially closed sides 56, with one or more doors 32 preferably removably attached thereto. If desired, a bin extension 18 (shown in FIG. 2) having an open top 58 and bottom 60 and closed sides 62 may be added between the removable lid 16 and the bin stack 40 (or between the removable lid 16 and the upper bin member 48). The bin stack 40 and bin extension 18 each increase the amount of space 24 present in the bin 14 for storing and dispensing food products 26.

The bin 14, bin stack 40, and bin extension 18 are each divided by one or more vertical partitions 28 which preferably extend from the bottom 64 of the bin 14 upwards to the open top 20 thereof (or of a bin stack 40 or bin extension 18), and which may vary in width and positioning within the bin 14. The vertical partitions 28 divide the bin 14 into two or more compartments 66, which permit the dispensing of two or more different types of food product 26 from the food product dispenser 10. One vertical partition 28 will divide the bin 14 into two compartments 66 (for dispensing two different types of food product 26), two vertical partitions 28 will divide the bin 14 into two, three or four compartments, depending upon the width of the vertical partitions 28 and the positioning of the vertical partitions 28 within the bin 14 (for dispensing two, three or four different types of food products 26), and so forth. It is preferable that the vertical partitions 28 are removable. This facilitates the cleaning of the vertical partitions 28, and allows the separate compartments 66 created thereby to be combined into one or more larger compartments 66.

Each of the compartments 66 created by the vertical partitions 28 will have an open upper end 68 into which food products 26 may be loaded, a lower dispensing area 70 through which food products 26 may be accessed by consumers from outside of the dispensers 10, and a transition portion 72 through which food products 26 travel from the upper end 68 to the lower dispensing area 70. Each of the lower dispensing areas 70 should be sufficiently large to hold a plurality of food products 26, and to permit a consumer to choose among a plurality of food products 26 present in each of the lower dispensing areas 70. A food product dispenser 10 having such compartments 66 allows a consumer to choose from a plurality of different food products 26 disposed within the separated compartments 66. For example, a food product dispenser 10 having five vertical partitions 28 may be used to dispense five different varieties of bagels (one variety of bagel from each of the five compartments 66 created). Each of these five compartments 66 preferably has sufficient capacity to hold about eighteen four-ounce bagels.

Each compartment 66 has an opening 30 covered by a door 32 which permits access by consumers to the food products 26.

The size and shape of the openings 30 and doors 32 are not critical. For example, the openings 30 and doors 32 may be circular, oval, square, rectangular, triangular, pentagonal, or of other shapes.

The doors 32 may be made of the same material that is employed for the bin 14, such as metals, plastics (acrylics, etc.), glass, and similar materials, or they may be made from some other suitable materials. It is preferable that the doors 32 be made of a material which is transparent, or at least not opaque (clear plastic, clear glass, etc.), so that consumers may view the food products 26 without having to open any doors 32.

Each of the doors 32 preferably has an exterior knob or handle 96 to facilitate opening. The doors 32 are pivotably unsupported by hinges 74 which are removably attached to both the door 32 and the bin 14, to facilitate removal of the hinge 74 and the door 32 from the bin 14 for cleaning.

The bin 14 preferably has a bottom wall 34 having a plurality of openings 36 therein, through which food product 26 crumbs, poppy seeds, sesame seeds, and like items may fall. The bottom wall 34 may be made of a screen or mesh material. The size and shape of the openings 36 present in the bottom wall 34 should be large enough to permit crumbs, seeds and like items to fall therethrough, but small enough to prohibit food products 26 being dispensed to fall therethrough.

The lower bin member 50 functions as a bottom support for the bin 14, and is supported for rotation on the base 12.

Figure 3:
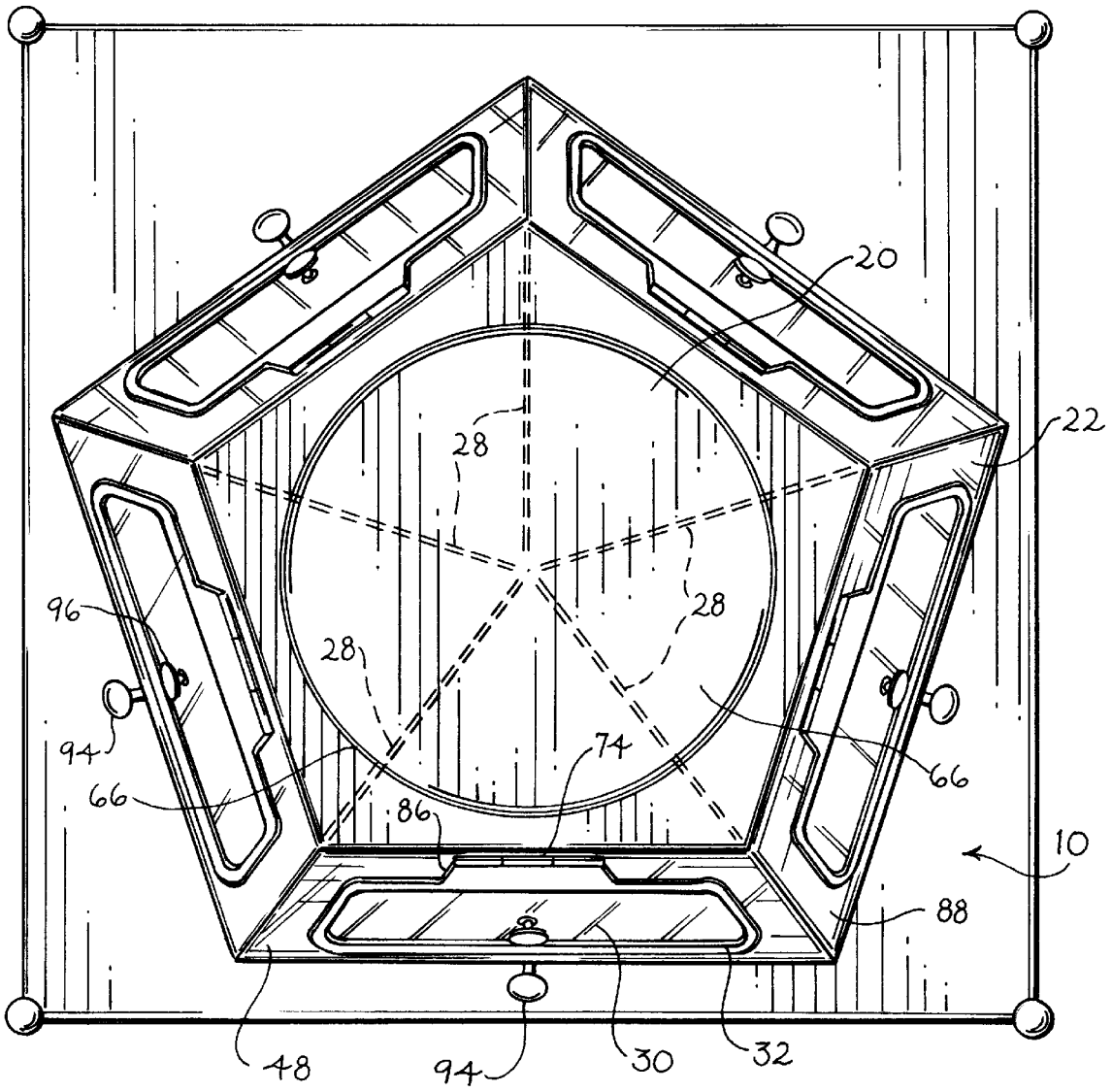
FIG. 3 is a plan view of the dispenser shown in FIGS. 1 and 2.

The bin 14 preferably has one or more rotation devices 94 which facilitate rotation of the product dispenser 10. Such devices 94 may be, for example, knobs, handles, or the like, and may be located at any convenient positions on the outside of the bin 14. FIGS. 1–3 show knobs on the outside of the upper bin member 48.

The shape of the bin 14 is not critical. For example, the bin 14 may have a shape which is circular, square, triangular, rectangular, pentagonal, or another shape as viewed in plan. The illustrated bin 14 for dispensing five different types of food product 26 has a pentagonal shape as viewed in plan, as is shown in FIG. 3.

The bin 14, and each of its components, and the other components of the food product dispensers 10 of the invention, may be made of various materials. In one particular embodiment, the removable lid 16 is made of ABS vacuum-formed plastic, and the upper 48 and lower 50 bin members, bin stack 40 and bin extension 18 are made of PTGE plastic.

The receptacle 76 is located below the bottom wall 34 of the bin 14 and functions to receive food product 26 crumbs, seeds and like items which fall through the openings 36 in the bottom wall 34, and to hold these food items out of the sight of consumers for later disposal. The receptacle 76 is preferably removable, to permit food product 26 crumbs and seeds to be easily removed therefrom, and is washable in a dishwasher. The receptacle 76 may be, for example, a slidable drawer.

Although the size and shape of the receptacle 76 is not critical, it is preferable that the receptacle 76 be of a size which is at least as large as the bottom wall 34 of the bin 14, so that all of the food product 26 crumbs and seeds which fall through the bottom wall 34 are readily collected by the receptacle 76.

The base 12, which is located below the receptacle 76 and which can be supported upon any relatively flat surface (counter top, top of a cabinet, etc.), has a track 78 formed therein for rotatably supporting the bin 14. The bin 14 is rotatable on the track 78 in the base 12, and permits the food product dispenser 10 to be rotated from the outside by a consumer, preferably to at least 360 degrees. The rotation of the bin 14 allows a consumer to easily access each of the different food products 26 being dispensed thereby from a compact space while positioned in one place by rotating the dispenser 10.

Preferably, a shield 80 is disposed over the track 78 to prevent food product 26 crumbs, seeds and similar items from falling into the track 78 and impeding the ability of the bin 14 to rotate. The shield 80 in the illustrated embodiment is principally intended to prevent foreign material from entering the track 78 from the outside, particularly to address the problems which may be presented by poppy seeds bouncing on the upper surface of the base 12 and landing in the track 78. Thus, the shield 80 extends circumferentially outward above and around the outer wall of the track 78. The shield 80 may be in direct contact with the bin 14 so as to rotate therewith, or may be otherwise associated with the bin 14, to prevent seeds, etc. from entering the track 78 from the outside of the dispenser 10.

The bin 14 preferably has no square corners and no separate fasteners, but rather has stackable components with rounded corners which may be mechanically assembled and disassembled without using tools. Such an assembly facilitates the cleaning of the various components, either by hand or in a dishwasher.

Compartments 82 may be provided in the base 12 for holding tongs, napkins, utensils, bags, condiments, and like items.

As described above, the invention enables generally first-in, first-out dispensing of food products 26. The expression "generally first-in, first-out" is intended to denote that dispensing is not strictly on a first-in, first-out basis, but that generally, after withdrawal of a number of food products 26 from the lower portion 84 of the bin 14, the dispensed products 26 may be replaced with new, fresh products 26 at the top 20 of the bin 14, and the fresh products 26 are not positioned for withdrawal in the lower portion 84 until after displacement of products 26 already in the lower portions 84 of the bin 14.

Each door 32 is hinged near its upper edge 86 in the preferred embodiment and suspended from the hinge 74 so that the doors 32 will be closed by gravity, and will be maintained in closed position by gravity against the associated exterior wall surfaces 88 of the upper portion 90 of the bin 14, which slope upwardly and inward. The doors 32 are disposed on the upper bin portion 90.

The walls 92 of the lower bin portion 84, in contrast, slope upward and outward to reduce the space requirements for the lower portion 84 of the dispenser 10 on the counter surface or other surface on which it is supported.

Although certain preferred embodiments of the food product dispensers of the present invention have been shown and described herein, those of ordinary skill in the art will recognize numerous variations, modifications and substitutions which may be made as by adding, combining, subdividing parts, or by substituting equivalents. Thus, the invention is not limited to the embodiments described herein.

What is claimed is:

1. A self-serve apparatus for dispensing more than one type of food product comprising:

(a) a removable lid;

(b) a bin, said bin having an open top, having closed sides, having space for the storage of more than one type of food product, having at least one vertical partition to separate such food products, having at least one opening and one door for each type of food product being housed therein through which said food product may be accessed from outside of said bin, having a bottom wall with a plurality of openings through which separated food product items may fall;

(c) a receptacle for receiving food product crumbs located below said bin; and (d) a base located below said bin for rotatable supporting said bin, wherein said base includes a track for rotatably supporting said bin, and a shield disposed thereover for preventing said separated food product items from falling therein; said bin being rotatable on said base, and said apparatus permitting the access of more than one type of food product generally on a first in, first out basis.

2. A compact self-service bagel dispenser which provides customers with a selection of a plurality of different groups of bagels, and a plurality of different bagels within each group, within a small dispensing area comprising:

(a) a base; and (b) a rotatable bin supported on said base comprising a plurality of separate compartments separated from one another by generally vertical dividers; each compartment having an open upper end into which bagels may be loaded, a lower dispensing area, and a transition portion through which bagels travel from said upper end to said lower dispensing area; each said lower dispensing area having a door for selective access thereto for dispensing of said bagels; said bagel dispenser enabling customers to choose from a plurality of different groups of bagels disposed in said separate compartments, and further enabling customers to choose from among a plurality of different bagels within each group in a respective lower dispensing area of each compartment, each said lower dispensing area being sufficiently large to hold a plurality of bagels;

wherein said bin includes a bottom wall having a plurality of openings therein to permit crumbs to pass therethrough, and wherein said base includes a drawer which receives said crumbs to hold said crumbs out of sight for later disposal, said drawer being removable from said base to facilitate disposal of said crumbs.

3. A compact self-service bagel dispenser which provides customers with a selection of a plurality of different groups of bagels, and a plurality of different bagels within each group, within a small dispensing area comprising:

(a) a base; and (b) a rotatable bin supported on said base comprising a plurality of separate compartments separated from one another by generally vertical dividers; each compartment having an open upper end into which bagels may be loaded, a lower dispensing area, and a transition portion through which bagels travel from said upper end to said lower dispensing area; each said lower dispensing area having a door for selective access thereto for dispensing of said bagels; said bagel dispenser enabling customers to choose from a plurality of different groups of bagels disposed in said separate compartments, and further enabling customers to choose from among a plurality of different bagels within each group in a respective lower dispensing area of each compartment, each said lower dispensing area being sufficiently large to hold a plurality of bagels;

wherein said bin comprises a stack of components which are mechanically inter-engageable without separate fasteners, to enable said bin to be assembled and disassembled for cleaning without the use of tools.

4. A compact self-service bagel dispenser which provides customers with a selection of a plurality of different groups of bagels, and a plurality of different bagels within each group, within a small dispensing area comprising:

(a) a base; and (b) a rotatable bin supported on said base comprising a plurality of separate compartments separated from one another by generally vertical dividers; each compartment having an open upper end into which bagels may be loaded, a lower dispensing area, and a transition portion through which bagels travel from said upper end to said lower dispensing area; each said lower dispensing area having a door for selective access thereto for dispensing of said bagels; said bagel dispenser enabling customers to choose from a plurality of different groups of bagels disposed in said separate compartments, and further enabling customers to choose from among a plurality of different bagels within each group in a respective lower dispensing area of each compartment, each said lower dispensing area being sufficiently large to hold a plurality of bagels; wherein said bin is rotatable on said base, said base including a track for rotatably supporting said bin, said dispenser further comprising a shield disposed over said track to prevent seeds and other particulates from falling into said track.

* * * * *

UNITED STATES PATENT AND TRADEMARK OFFICE

CERTIFICATE OF CORRECTION

PATENT NO. : 5,868,476

DATED : February 9, 1999

INVENTOR(S) : SAMBORN et al.

It is certified that error appears in the above-indentified patent and that said Letters Patent is hereby corrected as shown below:

Column 6, line 10, change "rotatable" to --rotatably--.

Signed and Sealed this

Twenty-seventh Day of July, 1999

*Attest:*

Q. TODD DICKINSON

*Attesting Officer*

*Acting Commissioner of Patents and Trademarks*